United States Patent [19]

Knauss

[11] Patent Number: 4,980,537

[45] Date of Patent: Dec. 25, 1990

[54] ELECTRIC HEATING DEVICE

[75] Inventor: Hermann Knauss, Oberderdingen, Fed. Rep. of Germany

[73] Assignee: E.G.O. Elektro Gerate Blanc u. Fischer, Fed. Rep. of Germany

[21] Appl. No.: 199,949

[22] Filed: May 27, 1988

[30] Foreign Application Priority Data

Jun. 5, 1987 [DE] Fed. Rep. of Germany ..... 3718836

[51] Int. Cl.[5] ..... H05B 3/00

[52] U.S. Cl. ..... 392/459; 219/546; 219/535; 392/479

[58] Field of Search ..... 219/300–309, 219/535, 311, 543, 421, 530, 536, 544, 546

[56] References Cited

U.S. PATENT DOCUMENTS

| | | | |
|---|---|---|---|
| 3,398,262 | 8/1968 | Kahn | 219/301 |
| 3,718,804 | 2/1973 | Ando | 219/301 |
| 4,123,837 | 11/1978 | Horner | 219/301 |
| 4,644,140 | 2/1987 | Hillingger | 219/301 |

FOREIGN PATENT DOCUMENTS

| | | |
|---|---|---|
| 1139589 | 11/1962 | Fed. Rep. of Germany . |
| 3221348 | 12/1983 | Fed. Rep. of Germany . |
| 8437042 | 3/1985 | Fed. Rep. of Germany . |

*Primary Examiner*—M. H. Paschall

*Attorney, Agent, or Firm*—Eckert Seamans Cherin & Mellott

[57] ABSTRACT

In the case of a heating device (1*a*) particularly suitable as a continuous flow heater, on an outer surface (4*a*) of a wall (3*a*), a tubular heater (6*a*) and a heat conducting element (10*a*) are so closely arranged in juxtaposed portions (14*a*) that the heat conducting element (10*a*) with a flat side (12*a*) and the heating element (6*a*) with a contact surface (16*a*) are uninterruptedly connected to said surface (4*a*) by means of very thin layers of a solder-like fixing material (11*a*). The longitudinal edge faces (21) of the strip-like heat conducting element (10*a*) are substantially connected to adjacent portions (14*a*) of the heating element (6*a*) and by means of solder-like fixing material are connected uninterruptedly to said heating element (6*a*). The heat conducting element (10*a*) flanking on either side the portion (14*a*) of the heating element (6*a*) with the fixing material (11*a*), together with the latter and the wall (3*a*) brings about a substantial homogenization of the distribution of the thermal energy emanating from the heating element portions (14*a*) on the facing surface (5*a*) of the wall (3*a*) used for heating a medium.

38 Claims, 2 Drawing Sheets

ELECTRIC HEATING DEVICE

BACKGROUND OF THE INVENTION

The invention relates to a heating device having at least one wall, at least one heating element, at least one heat conducting element and a for example meltable fixing material.

Prior Art

In the case of heating apparatus of the present type and which e.g. in accordance with DE-OS 32 21 348, DE-AS 11 39 589 or German utility model 84 37 042 are constructed as continuous flow heaters, there is often a need to obtain a very uniform heat distribution on the wall to be heated, because as a result it is possible to achieve a very uniform heat action on the medium to be heated. However, the fact that the heating element only directly heats limited zones of the wall, whereas it only acts on the adjacent zones with which it is not in contact by heat conduction, is prejudicial to such a uniform heat distribution. Thus, there is a tendency in the wall or in its surface subject to the action of the medium to be heated for there to be a non-homogeneous heat distribution or relatively high temperature differences, which in the case of a high input capacity can lead to specific overheating of the medium and in particular that the solids carried by the medium or other substances which tend to settle are deposited on the wall and gradually cover and block the associated surface. When a continuous flow heater is used for a washing machine, such substances are e.g. loose fabric threads, whereas in the case of a dishwashing machine they are e.g. food remnants.

To reduce these disadvantages the construction according to DE-OS 32 21 348 has led to good results. However, it has been found that the application of relatively large quantities of solder can e.g. lead to the problem that in the molten state the solder flows from higher to lower wall zones and as a result of its limited thermal conductivity is not always suitable in an optimum manner as a heat conductor. If in the solder is embedded a separate, web-like, upright heat conductor, although the heat transfer is favorably influenced, for this purpose the associated portions of the heating element should be almost uninterruptedly connected on either side of said heat conductor, which would therefore require a relatively long heating element.

SUMMARY OF THE INVENTION

An object of the present invention is to provide a heating device of the aforementioned type which, in the case of simple construction and manufacture, also permits a very uniform heat distribution over the requisite wall zones, even if the latter are relatively large compared with the zones directly heated by the heating element.

In the case of the heating device of the aforementioned type, this object is achieved by arranging the heat conductor's outside remote from the wall further away from the latter than the contact side of the heater facing the wall. The heat conductor, while taking account of its specific coefficient of thermal conductivity, can be so designed with respect to its cross-section, that it removes part of the thermal energy produced by the heating element directly from the latter by heat conduction and uniformly distributes it over the associated wall zones and generally up to the center of the gap between two adjacent heater portions, while a further part of the thermal energy is substantially directly supplied to the wall and both parts are so matched to one another that a homogeneous heating field is obtained.

The heat conductor can essentially be made from a single material, e.g. a suitable solder applied with an adequate coating thickness, but it is appropriate to form it from at least two different materials, namely in particular on the one hand the fixing material and on the other the additional heat conducting element. With regards to the cross-sectional or volume proportion relative to the total cross-section or volume of the heat conductor, the fixing material can take up the larger proportion, but it is generally preferable if the heat conductor is constructed in such a way that the additional heat conducting element assumes the much larger proportion, so that the fixing material need only be used in that quantity necessary for fixing the additional heat conductor and the heating element directly fitted to the wall. Appropriately the additional heat conducting element is substantially completely or in whole-area manner surrounded or covered by the fixing material, so that it is possible to use a non-stainless structural steel, e.g. a steel sheet or strip, which on the one hand has a good heat conductivity and on the other is protected against oxidation or corrosion without any additional expenditure, by coating with the fixing material.

BRIEF DESCRIPTION OF THE DRAWINGS

These and further features of preferred developments of the invention can be gathered from the description and drawings, whereby the individual features either alone or in the form of subcombinations can be realized in any embodiment of the invention and in other fields. The invention is described relative to non-limitative embodiments and the attached drawings, wherein are shown.

DETAILED DESCRIPTION OF THE PREFERRED EMBODIMENTS

Figure 1:
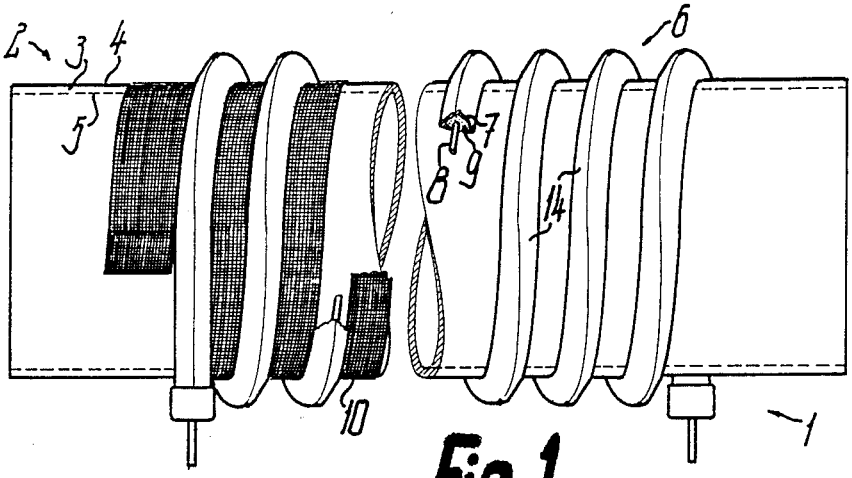
FIG. 1: a view of an inventive heating device constructed as a continuous flow heater.
Figure 2:
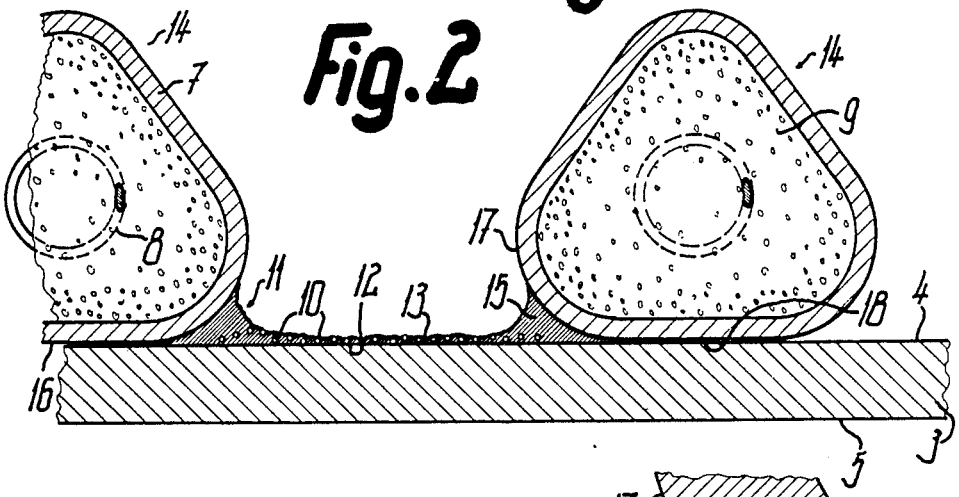
FIG. 2: a detail of FIG. 1 in section and on a significantly larger scale.
Figure 3:
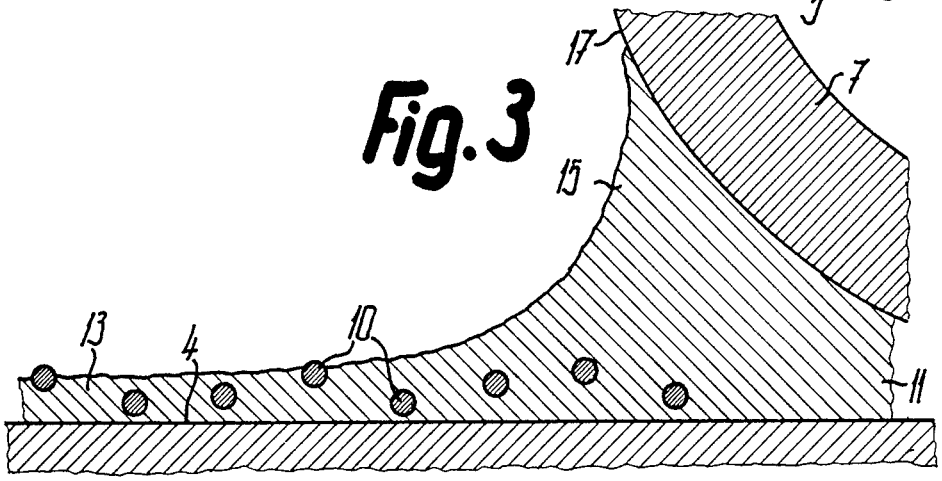
FIG. 3: a detail of FIG. 2 on a still larger scale.

The heating device 1 according to FIGS. 1 to 3 has a cylindrical tubular body with an external diameter of preferably approximately 40 mm and which is appropriately formed by a portion of an e.g. cold-drawn, seamless precision tube with extremely small tolerances, which has over its entire length substantially a constant internal and external diameter and is provided with relatively smooth surfaces 4,5 of limited roughness. The tubular body 2 is formed by a cylindrical wall 3, which has the outer surface 4 and the inner surface 5. In the case of a heating apparatus constructed e.g. as a heating plate, the wall could be approximately planar. The outer surface 4 serves as the heat input surface for the direct temperature action through a heating element 6, while the inner surface 5 serves as a heat output surface for the direct heating of a medium, e.g. rinsing or washing water or deep fat fryer fat, which appropriately travels as a flowing stream along the surface 5 and in the case of constructing the heating apparatus 1 as a channel-like continuous flow heater is conveyed from bottom to top by thermosiphonic action at a flow rate dependent on its temperature. If the heating apparatus 1 is connected as a circulating heater in a circuit, then there might be no need for a separate medium conveying device, e.g. a pump, which is advantageous in most cases. Instead of a band-like, flat heating element, an electrical heating element in the form of a tubular heater is appropriately provided and its outer casing 7 is formed by a substantially closed, thin-walled tube, in which is embedded in contact-free manner a helical heating wire or resistor 8 within an insulating mass 9, The elongated, strand-like heating element 6 can in cross-section be approximately acute-angled, triangular with three convexly rounded corner regions. In the represented embodiment the heating element 6 is wound in the manner of a helix with a constant pitch, so that in elevation view of the heating apparatus 2 there are heating element portions 14 juxtposed with uniform spacings and approximately parallel to one another. The pitch is selected in such a way that adjacent portions have an internal reciprocal spacing which is at least approximately $\frac{1}{4}$ of the cross-sectional width of the heating element 6 measured parallel to wall 3 and is in particular 2 to 8 times larger than the same and is appropriately approximately of the same order of magnitude as said cross-sectional width. In the represented embodiment the spacing approximately corresponds to $\frac{3}{4}$ of said cross-sectional width. The cross-sectional height of heating element 6 measured at right angles to wall 3 can admittedly be larger than the first-mentioned cross-sectional width, but is appropriately at least slightly smaller or at the most as large as the same. Heating element 6 is prewound on an internal diameter smaller than the external diameter of wall 3, so that in its elastic range it can at least be widened up to the external diameter of wall 3 through its end being turned against one another about its central axis corresponding to the opposite direction. In this widened or expanded state the heating element 6 can be engaged without difficulty on wall 3 and then by freeing its ends it is automatically elastically constricted again in such a way that its inner face is located over its entire length in an envelope surface coinciding with surface 4, so that said inner surface over the length and width thereof engages substantially uninterruptedly and under radially inwardly directed pretension on surface 4.

Through the heating element 6 between its portions 14 is formed a helical groove, whose base surface is formed by surface 4, while its lateral surfaces are formed by the facing flanks of the associated portions 14 or heating element 6. As a result of the described cross-sectional shape of heating element 6, the helical groove is constricted or narrowed in funnel-shaped manner in cross-section towards wall 3 up to a minimum width region relatively close to said wall 3 and from the latter is widened up to wall 3 to a width which is smaller than the maximum width on the open side of the helical groove.

Into the helical groove is inserted a flat or strip-like heat conducting element 10, whose width is appropriately at least as large as the smallest internal diameter of the helical groove and is in particular larger than the latter to such an extent that the heat conducting element 10 on at least one side of said groove extends into its inner widened region bounded by its base surface. The heat conducting element 10 appropriately extends at least partly directly up to the surface 4 of wall 3 and has a cross-sectional extension measured at right angles to said surface 4 which is appropriately at the most as large as its cross-sectional extension measured parallel to wall 3 and is in particular much smaller than this.

In order to achieve specific heat conducting characteristics, it is conceivable for the heat conducting element 10 to extend between the inner surface of the heating element 6 and the surface 4 of wall 3, but in this case it is appropriate if the heat conducting element has thinner marginal strips, so that it is thicker between portion 14 of heating element 6, i.e. in the helical groove. Therefore, at least in the vicinity of the helical groove, the heat conducting element 10 has a different heat conduction cross-section than in the vicinity of heating element 6.

Heat conducting element 10 is embedded in a solder-like fixing material 11 which, in the molten state, i.e. generally with corresponding heating, forms a fixing fluid which is sufficiently thin that under the weight forces which occur it flows automatically. With the heat conducting element 10, the fixing material 11 forms a composite conducting element, the fixing material 11 assuming the higher proportion in the represented embodiment. The fixing material 11 is constructed at least partly as a heat conducting layer positioned laterally adjacent to the heating element 6 for heat distribution over the associated area of wall 3. The heat conducting layer 13 is linked directly laterally with the heating element 6 and in particular with increasing distance from heating element 6 or the particular portion 14 is subject to a thickness decrease and preferably over a cross-sectionally wedge-shaped portion 15 engages laterally between the outer casing 7 of heating element 6 and wall 3 or its surface 4. The heat conducting layer 13 is also uninterruptedly adhesively joined to wall 3 and the outer casing 7 substantially with a closed surface. It is appropriate to use a fixing material, e.g. in the form of a high temperature-resistant solder for stainless steel, such as a nickel solder of such a type that it can diffuse into the wall 3 made from stainless steel, and in particular into the outer casing 7 also made from stainless or unalloyed steel. Through this and similar material composition of the parts to be fixed together, an intimate connection is obtained in the manner of an alloying connection, so that scarcely any thermal separation of the soldered parts is possible.

As a result of the described construction, layer 13, whose one flat side 12 is joined to wall 3, projects by at least 1/5 and in particular approximately by half the cross-sectional width of heating element 6 laterally over the latter or passes substantially uninterruptedly between adjacent portions 14 of heating element 6. As a function of requirements, the minimum thickness of layer 13 can e.g. be between 0.1 and 0.5 mm and is preferably at least 0.2 mm, the maximum thickness of the heat conducting layer being in particular smaller than the radius of curvature of the rounded regions 17 of the cross-section of outer casing 7, so that layer 13 does not or at the most extends into the minimum width region of the helical groove. The smallest thickness of layer 13 is appropriately smaller than the thickness of wall 3 and the layer, connected in the manner of a lamination to wall 3, preferably has a much higher specific heat conduction coefficient than wall 3. Compared therewith the heat conducting element 10 has an even higher specific heat conduction coefficient and compared with the fixing material 11 a higher melting temperature and is appropriately made from a metallic material. With the lateral marginal zones the heat conducting element 10 extends into the wedge-shaped portions 15.

In the represented embodiment for contact of the fixing fluid the heat conducting element 10 forms a flat and in particular fine embossed, structured securing member against flowing away during the soldering process, which e.g. takes place in a furnace, said securing member being then at least partly embedded in the manner of a reinforcement parallel to layer 13 in fixing material 11. Through the choice of the construction and thickness of said securing member, it is possible to determine the layer thickness in which, despite liquefying by heating, the fixing material can be built up and it is also possible to determine the proportion assumed by the fixing material in the complete union of the heat conducting layer 13. The securing function in particular results from the utilization of the surface tension of the fixing fluid, which can e.g. be achieved in that the securing member has a larger surface than its base surface, being in particular formed by at least one layer of a net, a sieve wire, a perforated film, a perforated strip, a metal mesh, steel wool or some similarly structured flat body, any random combination of layers from said flat bodies being conceivable. In certain cases it is in fact sufficient to form the securing member in such a way that the associated surface of wall 3 is roughened e.g. by milling, knurling or some other fine structured deformation of this type, so that it secures the fixing material against flowing away during the melting process. However, it is necessary to ensure in this case that the surface 4 of wall 3 in the vicinity of the connection to the heating element has a much smoother surface or retrains its original smooth surface nature.

Between its rounded corner regions 17 adjacent to wall 3 or surface 4, the outer casing 6 has a contact surface 16, which is cross-sectionally linear or located in a cylindrical envelope surface and which can be formed by the base side of the triangular cross-section and through the described measures engages substantially without spacing on surface 4. During the liquefying of the fixing material 11, the latter passes under the resulting capillary pressure between said contact surface 16 and surface 4, so that a paper-thin intermediate layer is formed there, whose thickness is roughly as wide as capillary gap 18 for the fixing fluid and which in alloying manner connects the outer casing 7 directly to wall 3.

In order to produce the heating apparatus 1, in the above-described manner the heating element 6 in uniform distribution is arranged on part of the wall 3 in such a way that its ends remain free for the connection of heating element lines. Between the portions 14 of heating element 6 is wound the flexible or bending heat conducting element 10 which, in the case of an adequate bending strength and as described relative to heating element 6 is helically prewound onto a narrower diameter and then together with the heating element 6 or before or after the latter is engaged accompanied by widening on wall 3, so that after release it resiliently springs into close engagement with surface 4. FIG. 1 shows the heat conducting element 10, but not the fixing material 11. The latter can either be wound in the manner of a strip about the heat conducting element 10 or in a prefabricating operation can be combined therewith to give an e.g. plated composite body in that by rolling or the like it is adhesively connected to the heat conducting element 10. The thus prepared heating apparatus 1 is heated in a furnace at least up to the melting temperature of the fixing material, so that the latter flows from the areas between portions 14 into the capillary gaps 18 and through perforations of the heat conducting element 10 and after cooling is intimately joined to said surfaces in the described manner. Immediately following onto the contact surface 16 a relatively large amount of heat is removed from the heating element 6 via wedge portions 15 and this is directly supplied to the zones of layer 13 adjacent to heating element 6 or the particular portion 14, while simultaneously within wall 3 heat flows from contact surface 16 in the direction of said zone, so that a very homogeneous temperature distribution is obtained on the inner surface 5.

Figure 4:
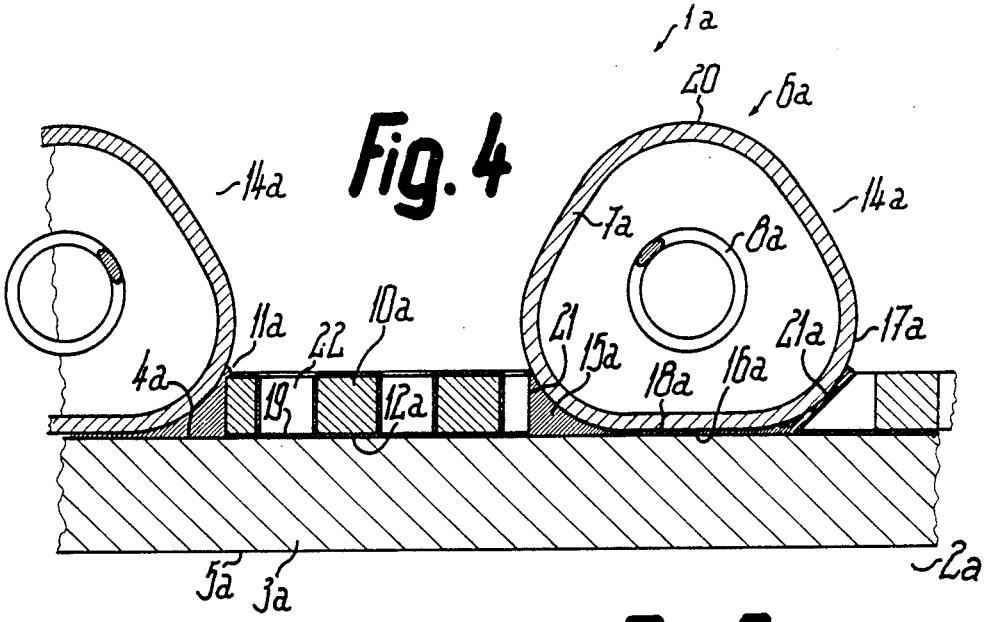
FIG. 4: another embodiment in a representation corresponding to FIG. 2.
Figure 5:
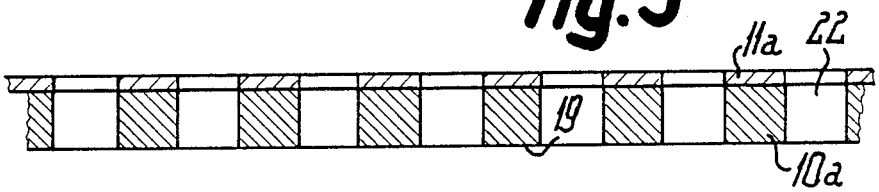
FIG. 5: the heat conducting element according to FIG. 4 in longitudinal section.
Figure 6:
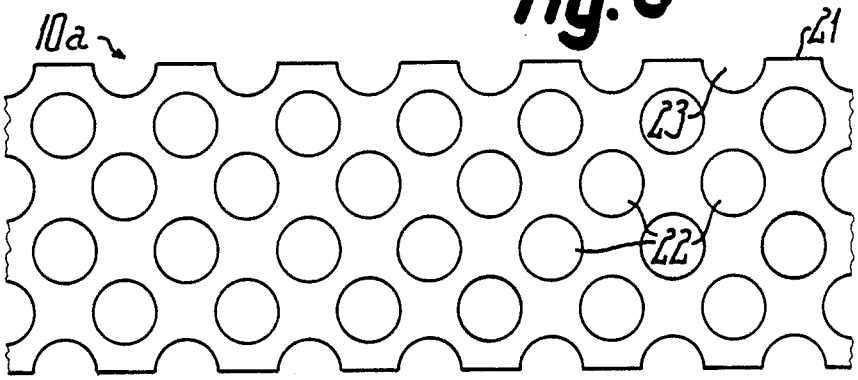
FIG. 6: a plan view of the heat conducting element according to FIG. 5.

In FIGS. 4 to 6 the corresponding parts are given the same reference numerals as in FIG. 1, but the letter "a" is added. In this embodiment the heat conducting element **10*a*, which appropriately takes up more volume than the fixing material 11*a*, is formed by a relatively stiff, cross-sectionally dimensionally stable strip material in the form of a single steel sheet or the like, which can have a thickness of e.g. somewhat less than 1 mm and more than 2 mm. It is significantly set back from the cross-sectional apices 20 remote from wall 3*a* and namely has a smaller thickness than half the cross-sectional height of heating element 6. The thickness of the heat conducting element 10*a*, at least in the area of the longitudinal edge faces 21 connected to heating element 6, can be smaller than the radius of curvature of the rounded areas 17*a*, so that the heat conducting element 10*a* can be resiliently snapped in between adjacent portions 14*a*. The longitudinal edge faces 21 extend substantially to directly laterally of the outer casing 7*a* of heating element 6*a*. The flat side 12*a* of heat conducting element 10*a* located in cross-sectionally linear or a cylindrical envelope surface substantially over the entire width of the heat conducting element 10*a*, is at a substantially constant capillary gap distance from surface 4*a*, so that said flat side 12*a* in its uninterrupted regions is connected by means of a paper-thin, substantially uninterrupted layer 19 of the fixing medium in almost directly contacting or alloyed diffused in manner to the surface 4*a*. Layer 19 passes uninterruptedly into the wedge-shaped portions 15*a* and from there into the capillary gaps 18*a*, the fixing material 11*a* substantially filling the space bounded by a rounded corner region 17*a*, a facing longitudinal edge face 21 and surface 4*a* and is also intimately connected to the longitudinal edge face 21. It is indicated to the right in FIG. 4 that the longitudinal edge face 21*a* can be so adapted to the contour of the facing corner region 17*a*, so that less fixing material is required for the area corresponding to portion 15*a*, because said area is at least partly filled with the heat conducting element 10*a*. The longitudinal edge face 21*a* can be inclined in such a way that the flat side 19 of heat conducting element 10*a* is wider than the side remote from wall 3*a* or can be so closely adapted to the contour of corner region 17*a*, that virtually only a capillary gap for receiving the fixing material is left. Thus, with heat conducting element 10*a*, also the portions 14*a* of heating element 6*a* can be kept precisely spaced prior to fixing to wall 3*a***.

Heat conducting element **10*a* is provided with openings 22 emanating from its flat side 12*a* and in the represented embodiment are distributed in the manner of a pattern perforation over the base surface of the heat conducting element 10***a* and as constant width openings over its entire thickness. On liquefying, the fixing material or fluid passes at least in layer-like manner onto the surfaces bounding these openings 22 and also on all the other surfaces, so that the heat conducting element 10*a* is substantially completely sealed by at least one thin layer of fixing material 11*a*. As a function of the quantity of fixing material 11*a* used, the openings 22 can also be partly or completely filled with the fixing material.

As is in particular shown in FIG. 6, the heat conducting element 10*a* is provided over its longitudinal edges 21 with uniformly distributed inspection windows 23 in the form of edge-open cutouts, which are e.g. V-shaped, rectangular or the like and serve to make it optically simple possible in the vicinity of said faces 21 to establish whether the fixing material has adequately filled the cavities following onto the longitudinal edge bases 21. In the represented embodiment the inspection windows 23 are formed by the perforation system forming openings 22 in such a way that the longitudinal edge face 21 is located in an area, in which a row of perforations is cut in such a way that semicircular inspection windows 23 are formed distributed in accordance with the perforation pattern.

As shown in FIG. 5, the heat conducting element 10*a* can be joined to the fixing material 11*a*, e.g. applied by plating and in the form of a layer in a prefabricating operation, the fixing material 11*a* being appropriately applied prior to the formation of the perforations on the side of the heat conducting element 10*a* remote from the flat side 19 and then the perforation system which also passes through material 11*a* is produced. The heat conducting element 10*a* is provided with such a large amount of fixing material 11*a*, that there is no need to add further solder and instead the solder present on the heat conducting element 10*a* is sufficient for fixing heating element 6*a* in the described manner. As there is also solder on the side of the heat conducting element 10*a* remote from flat side 19, on melting it flows from said side through openings 22 and in the vicinity of longitudinal edge face 21 to surface 4*a*, thus giving the described coating of the heat conducting element 10*a* and the fixing of heating element 6*a* and heat conducting element 10*a*. Between the portions of the heating element it is also possible to apply a nickel or V2A net, e.g. in the form of a sieve wire and around it can be wound a solder film. The sieve wire can also be rolled into a copper film. It is particularly appropriate to use as the heat conducting element a good heat conducting sheet metal strip with a thickness of approximately 0.3 to 0.5 mm. The width of the heat conducting element can e.g. be approximately 6 mm and can have perforations with a diameter of 2.5 to 3 mm, there being a distance of e.g. 5 to 6 mm between the holes. The holes can also have a smaller diameter, it being particularly appropriate for the holes to act in sieve-like manner on the fixing fluid.

If, apart from the heating element 6*a*, wall 3*a* is also to carry a temperature sensor of a temperature regulator or limiter, then the latter is appropriately also arranged on surface 4*a* and is formed by an elongated, tubular temperature sensor of a system filled with an expansion fluid. The temperature sensor is appropriately placed in a U-shaped support profile, whose crossbar outside is fixed by means of a capillary gap-thick layer of the fixing medium to surface 4*a* and whose profile leg can be bent in closely engaging manner around the temperature sensor in such a way that it is surrounded by the support profile over more than half of its circumference and length and in particular over its substantially entire circumference and length. If a leg of the support profile is immediately adjacent to a tubular heater portion 14*a*, then the temperature sensor is strongly influenced by said portion 14*a* and not only by the temperature of wall 3*a* and consequently responds particularly rapidly in the case of overheating. In order to be able to particularly adequately dissipate the heat from the portions 14*a* of heating element 6*a* belonging to the temperature sensor, instead of this it is possible to arrange the support profile or temperature sensor roughly in the center between two adjacent tubular heating portions 14*a*, the arrangement directly on the associated side of the heat conducting element 10*a* or on the surface 4*a* taking place in such a way that the support profile is flanked on at least one side by a correspondingly narrower heat conducting element, which on the one hand serves for heat distribution in wall 3*a* and on the other as a heat conduction bridge between the temperature sensor and the associated portion 14*a* of heating element 6*a*. The support profile can also be tubular.

I claim:

1. An electric heating device, comprising:

a wall to be heated, the wall providing at least one surface defining a side;

an electrical heating means having an electrical heating element providing an outer jacket, said heating element having a fixing surface fitted to said surface of the wall and said heating means forming at least one heating portion providing an elongated portion and said fixing surface;

an additional structure located laterally adjacent to at least one of said elongated portion of the heating element and providing a heat conducting means between the heating portion and the wall;

a solder-like fixing material forming a fixing fluid in a molten state and joining the outer jacket of the heating element to said additional structure, as well as at least partially embedding said additional structure, wherein the additional structure has an inner side providing a flat boundary extending substantially parallel to said side of the wall and laterally adjacent to said fixing surface, said flat boundary being substantially embedded in an associated section of the fixing material connecting directly to said surface of the wall, a film-like thin and substantially uninterrupted layer of said fixing material laterally continuing from said associated section and said heat conducting structure into a fixing gap provided between said heating portion and said surface of the wall.

2. An electric heating device, comprising:

a wall to be heated and providing at least one surface defining a side;

at least one heating portion of an electrical heating element of an electric heating means providing an outer jacket, said heating portion having a fixing surface fitted to said surface of the wall and defining lateral fixing boundaries of a fixing gap;

an additional structure associated with said heating portion and said surface of the wall, said additional structure determining a flat inner side closely associated with said wall over a width extension;

a fixing material joining at least one said at least one heating portion to said surface of the wall in the vicinity of said fixing gap and connected to said additional structure; and, wherein said additional structure extends laterally outside said at least one heating portion from at least one of said lateral fixing boundaries.

3. The heating device according to claims 1 or 2, wherein said additional structure and at least one said at least one heating portion are juxtaposed, said additional structure having at least one lateral longitudinal edge boundary located laterally substantially directly adjacent to the outer jacket of the heating element and laterally facing said heating portion.

4. The heating device according to claim 3, wherein said additional structure is provided with longitudinally distributed cutouts forming inspection windows on said longitudinal boundary.

5. The heating device according to claims 1 or 2, wherein said heating element has cross-sectional apices remote from the wall, said additional structure being displaced towards said side of said wall relative to said apices of the heating element.

6. The heating device according to claims 1 or 2, wherein said heating element has a cross-sectional height, said additional structure having a thickness smaller than half the cross-sectional height of the heating element.

7. The heating device according to claims 1 or 2, wherein said heating element has in cross-section rounded corner regions on the outer jacket, a thickness extension of the additional structure, at least in the vicinity of a longitudinal edge boundary of the additional structure at the heating element, being smaller than a radius of curvature of said rounded corner regions of the heating element.

8. The heating device according to claims 1 or 2, wherein said additional structure provides an additional element separate from said wall and said fixing material when in a fluid state determines a capillary gap of a predetermined width extension, a spacing of a flat side providing said flat boundary of the additional structure from said surface of the wall corresponding substantially at most to said width extension of the capillary gap for the fixing fluid, thereby providing a film-like thin and substantially uninterrupted layer of fixing material connecting substantially said entire flat side to said surface of the wall.

9. The heating device according to claims 1 or 2, wherein said outer jacket of the heating element has a contact surface closely facing said surface of the wall, said contact surface being substantially parallel in cross-section to said flat boundary, said fixing material when in a fluid state occupying a capillary gap of a predetermined width extension, said fixing gap being defined by a spacing of the contact surface of the heating element from said surface of the wall corresponding substantially at most to said width extension of the capillary gap for the fixing material, thereby providing a film-like thin and substantially uninterrupted layer of fixing material connecting substantially said entire contact surface to said surface of the wall.

10. The heating device according to claims 1 or 2, wherein at least one longitudinal edge boundary of the additional structure is connected via the fixing material directly to a laterally facing zone of the outer jacket of the heating element.

11. The heating device according to claim 10, wherein a space is cross-sectionally defined by the longitudinal edge boundary laterally displaced with respect to said fixing surface, the facing zone of the heating element and the surface of the wall, said space being completely filled with the fixing material.

12. The heating device according to claims 1 or 2, wherein said additional structure has openings emanating from said inner side.

13. The heating device according to claim 12, wherein said openings extend through a thickness extension of the additional structure.

14. The heating device according to claim 12, wherein said openings are uniformly distributed in patterned manner and are at least partly filled with the fixing material.

15. The heating device according to claims 1 or 2, wherein said additional structure has a structured flat body and includes at least one of a perforated metal sheet, a net, a sieve wire, a perforated film, a perforated strip, a metal mesh, and steel wool.

16. The heating device according to claims 1 or 2, wherein said surface of the wall is smooth at least in the vicinity of the heating element.

17. The heating device according to claims 1 or 2, wherein laterally adjacent portions of said heating element are substantially uniformly distributed on said surface of the wall.

18. The heating device according to claims 1 or 2, wherein said surface of the wall is an outer face remote from an inner surface of the wall, said inner surface being provided for heating a medium.

19. The heating device according to claims 1 or 2, wherein said surface of the wall is smooth at least in a vicinity of the additional structure.

20. The heating device according to claims 1 or 2, wherein laterally adjacent sections of said additional structure are substantially uniformly distributed on said surface of the wall.

21. The heating device according to claims 1 or 2, wherein said wall forms a tube wall.

22. The heating device according to claims 1 or 2, wherein said wall is a wall of a continuous flow heater.

23. The heating device according to claims 1 or 2, wherein at least an inner surface of said wall is continuously smooth-surfaced.

24. The heating device according to claims 1 or 2, wherein said heating element is formed by a tubular heater having an outer jacket made from metal.

25. The heating device according to claims 1 or 2, wherein said heating element is arranged helically with at least two juxtaposed heating portions connected by a layer of fixing material attached to a section of said additional structure located between said at least two juxtaposed heating portions.

26. The heating device according to claims 1 or 2, wherein the additional structure is disposed in strip-like manner between at least two spaced heating portions of the heating means, lateral boundaries of the additional structure laterally facing two of said adjacent heating portions.

27. The heating device according to claims 1 or 2, wherein the additional structure has an interruption fitting laterally with the fixing gap and the fixing surface of at least one said at least one heating portion of the heating element.

28. The heating device according to claims 1 or 2, wherein the additional structure is completely coated with the fixing material.

29. The heating device according to claims 1 or 2, wherein the additional structure is made from ordinary steel.

30. The heating device according to claims 1 or 2, wherein the additional structure and the fixing material are commonly constructed as a prefabricated strip-like sandwich body placed onto the wall and containing the fixing material provided for flowing between the heating element and the wall.

31. The heating device according to claim 30, wherein said sandwich body is a plated body.

32. The heating device according to claim 30, wherein said sandwich body contains said fixing material on a side remote from the flat boundary.

33. The heating device according to claims 1 or 2, wherein said additional structure is a flat member having a width extension extending laterally from said heating portion and constructed as a capillary holder for the fixing material when in a fluid state.

34. The heating device according to claims 1 or 2, wherein a section of said additional structure extending laterally adjacent to said heating portion is thermally connected to said heating portion by said fixing material.

35. The heating device according to claims 1 or 2, wherein said additional structure is located only outside said fixing gap.

36. The heating device according to claims 1 or 2, wherein said heating portion has a cross-sectional width extension, and said fixing material provides a layer extending laterally of said heating portion by at least a proportion between one fifth and one half of said width extension, said layer containing said additional structure.

37. The heating device according to claims 1 or 2, wherein said additional structure and said fixing material provide a compound layer extending laterally outside said fixing gap and said heating portion.

38. The heating device according to claims 1 or 2, wherein said additional structure provides an at least partially embedded reinforcement structure for a layer of said fixing material, said layer being located laterally outside said heating portion.

* * * * *